US007621265B2

(12) United States Patent
Halmone

(10) Patent No.: US 7,621,265 B2
(45) Date of Patent: Nov. 24, 2009

(54) COMPACT PAINTBALL MARKER

(75) Inventor: Fabrice N. V. Halmone, Ville la Grande (FR)

(73) Assignee: Kingman International Corporation, Baldwin Park, CA (US)

( * ) Notice: Subject to any disclaimer, the term of this patent is extended or adjusted under 35 U.S.C. 154(b) by 0 days.

(21) Appl. No.: 12/350,827

(22) Filed: Jan. 8, 2009

(65) Prior Publication Data

US 2009/0114201 A1 May 7, 2009

Related U.S. Application Data

(62) Division of application No. 11/520,916, filed on Sep. 13, 2006, now Pat. No. 7,478,632.

(51) Int. Cl.
*F41B 11/00* (2006.01)

(52) U.S. Cl. ..... 124/74

(58) Field of Classification Search ..... 124/71–77
See application file for complete search history.

(56) References Cited

U.S. PATENT DOCUMENTS

| | | | | |
|---|---|---|---|---|
| 5,462,042 | A * | 10/1995 | Greenwell | 124/76 |
| 2001/0042543 | A1 * | 11/2001 | Perrone | 124/77 |
| 2003/0024520 | A1 * | 2/2003 | Dobbins | 124/73 |
| 2003/0047175 | A1 * | 3/2003 | Farrell | 124/76 |
| 2007/0017497 | A1 * | 1/2007 | Masse | 124/73 |

OTHER PUBLICATIONS

PCT International Search Report, dated Jun. 8, 2008, mailed Jul. 17, 2008, International Application No. PCT/US07/19346, International Filing Date Sep. 5, 2007, 7 pgs.

* cited by examiner

*Primary Examiner*—Troy Chambers
(74) *Attorney, Agent, or Firm*—Blakely, Sokoloff, Taylor & Zafman, LLP

(57) ABSTRACT

A compact paintball marker having an internal paintball holding mechanism, internal compressed gas holding mechanism and distributed striker mechanism. The strike mechanism is divided between two compartments with the striker in a proximal compartment and a biasing mechanism in the distal compartment. The striker is coupled to the biasing mechanism by a striker shaft that may be disposed at least partially external to the housing of the marker.

8 Claims, 8 Drawing Sheets

COMPACT PAINTBALL MARKER

This patent application is a divisional of Ser. No. 11/520,916 filed on Sep. 13, 2006 now U.S. Pat. No. 7,478,632 entitled COMPACT PAINTBALL MARKER.

BACKGROUND

1. Field of the Invention

The present invention relates to a paintball marker with a compact form. Specifically, the paintball marker has a handgun shape and a compact striker mechanism.

2. Description of the Related Art

Paintball markers are shaped to resemble rifles having long barrels and housings. The long housings are necessary to accommodate the internal components of the marker including the striker mechanism and bolt mechanism. The housing of a paintball marker defines two parallel tubes in which these components may be disposed. The top tube or barrel includes a bolt that positions a paintball and directs airflow behind the paintball to propel the paintball. The paintball is inserted into the barrel from a loader that is positioned above the marker housing and has a feeding tube to provide the paintballs into the barrel.

The second tube is directly below the barrel and parallel to the barrel. The second tube contains a striker mechanism that repositions the bolt to load the next paintball after firing and readies the marker for the next firing. The striker mechanism also releases compressed gas into the barrel in response to the activation of a trigger mechanism. A valve is positioned in a distal end of the second tube. The valve controls the flow of gas into the second tube from the compressed gas container that is externally attached to the marker. The valve is activated by the striker mechanism in response to the trigger activation. The striker mechanism is spring loaded at a proximal end of the second tube and held in a compressed position by the sear in the trigger mechanism.

Depressing the trigger releases the striker, which advances into contact with valve due to the decompression of the spring. The striker mechanism is also coupled to the bolt. Advancing the bolt opens an airflow path into the barrel through the bolt and seals the barrel from the feeder tube of the loader. The contact with the valve releases compressed gas into the second tube and the barrel propelling the paintball out of the marker and pushing the striker mechanism back to a cocked position.

The size of the striker mechanism limits the compactness and form of the marker. The striker mechanism including its spring and the second tube have dimensions that are designed to accommodate the gas pressure from the external canister. The second tube has a length to accommodate the necessary spring coil length along with the housing for the spring. The striker mechanism in its entirety is disposed proximal to the valve. Thus, the housing must have a length longer than the length of the striker mechanism and valve to accommodate these components. As a result, the housing has an elongated shape and is typically manufactured to resemble a rifle.

BRIEF DESCRIPTION OF THE DRAWINGS

Embodiments of the invention are illustrated by way of example and not by way of limitation in the figures of the accompanying drawings in which like references indicate similar elements. It should be noted that different references to "an" or "one" embodiment in this disclosure are not necessarily to the same embodiment, and such references mean at least one.

DETAILED DESCRIPTION

In the following description, for the purpose of explanation, numerous specific details are set forth to provide a thorough understanding of the various embodiments. It will be apparent to one of ordinary skill in the art that the embodiments may be practiced without some of these specific details. In other instances, certain structures and devices are omitted or simplified to avoid obscuring the details of the various embodiments.

The following description and the accompanying drawings provide examples for the purposes of illustration. However, these examples should not be construed in a limiting sense as they are not intended to provide an exhaustive list of all possible implementations.

Figure 1:
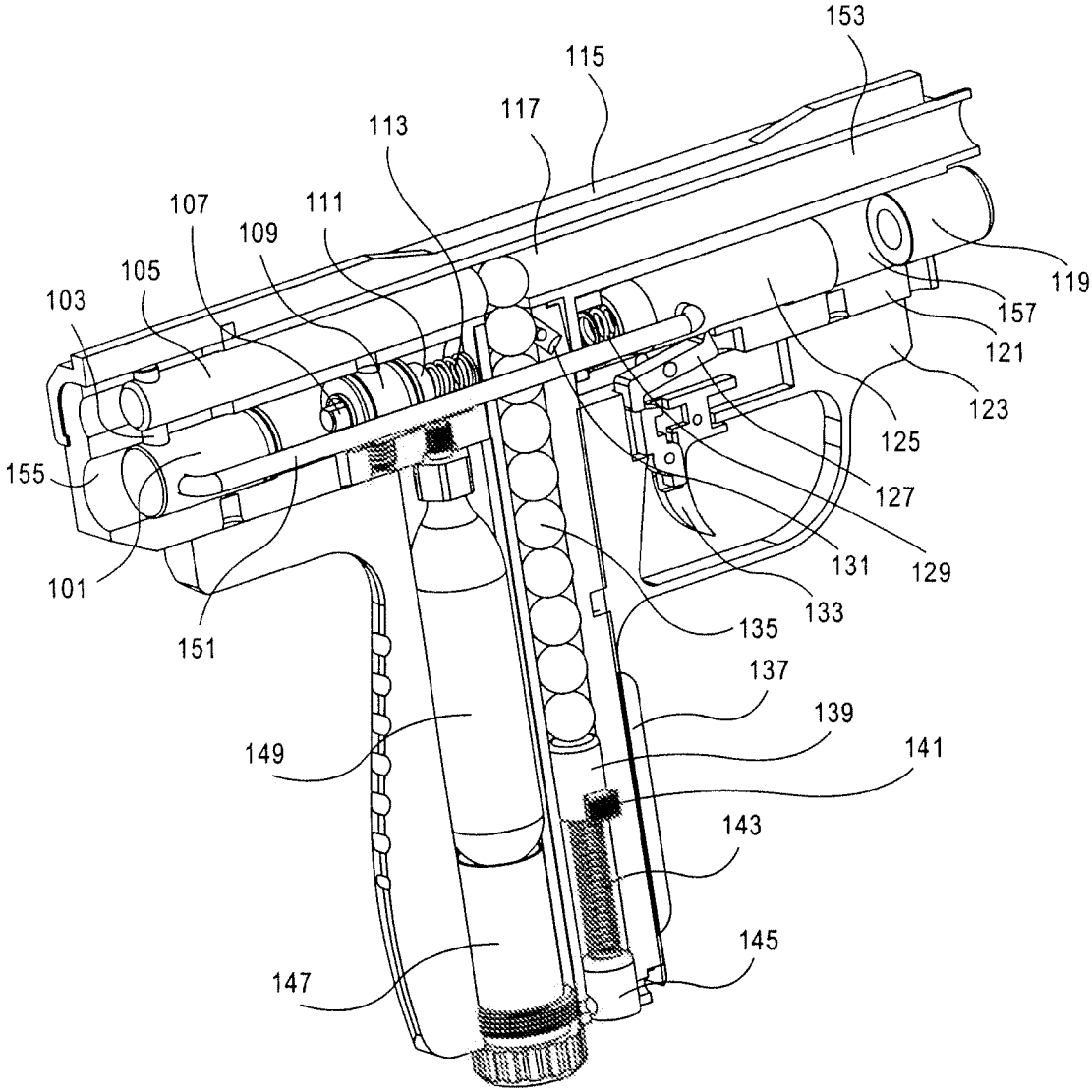
FIG. 1 is a diagram depicting a cross section of one embodiment of compact marker.

FIG. 1 is a diagram depicting a cross section of one embodiment of a compact marker. In one embodiment, a marker may propel paintballs in response to a pull of the trigger mechanism by a user. A marker may be used to mark trees, livestock or similar items at a distance or may be used in paintball sports where the user attempts to mark an opponent. The marker utilizes compressed gases as propellant for the paintballs. The marker may be a pump action, semi-automatic or fully-automatic device. For purposes of clarity the embodiments described herein relate to a semi-automatic device. One skilled in the art would understand that the principles and design are also applicable to other types of markers.

In one embodiment, a marker may include a housing containing multiple sub-assemblies including a trigger mechanism, a striker mechanism, a gas delivery mechanism, a paintball delivery mechanism and similar sub-assemblies or components. The housing may define a set of compartments or cavities for receiving the sub-assemblies or components of the marker. These spaces may include a barrel 153 through which a paintball exits the marker. The barrel 153 may have any diameter and length. In one embodiment, the length of the barrel 153 and marker may be less than ten inches in length or approximately 200 mm. In a further embodiment, the length of the barrel 153 and marker may be less than eight inches in length. The diameter of the barrel 153 may be selected to match a size of a type of paintball. For example, the barrel 153 may be designed to accommodate a 10 mm paintball.

A bolt 105 may be disposed within the barrel 153. The bolt 105 may slide from a first position in the barrel 153 to a second position in the barrel 153. The bolt 105 defines an airflow path that directs gas toward the paintball propelling it out of the barrel 153. The bolt 105 defines an opening in its outer wall that may be aligned with an opening in the barrel 153 through which gas from the valve 109 may be received if the bolt 105 is in the second position. In the second position, the outer wall of the bolt 105 blocks a path from the feeding tube into the chamber of the barrel 153 preventing another paintball from entering the barrel 153 during a firing action. If the bolt 105 is in the first position the outer wall of the bolt 105 blocks the airflow path, preventing the escape of compressed air. In the first position, a paintball may also enter the barrel 153 or chamber of the marker.

In one embodiment, the bolt 105 is driven by a striker mechanism. The striker mechanism may include a striker 101, a striker spring 129, a striker spring housing 125 and a striker shaft 151. The striker 101 is situated in a first compartment 155 that is adjacent and parallel to the barrel. The striker spring 129 and striker spring housing 125 are disposed in a second compartment 157. The striker spring housing 125 and striker 101 are attached to one another by the striker shaft 151, which runs parallel with the barrel 153, but primarily external to the housing of the marker.

The striker 101 is coupled to the bolt 105 by a bolt pin 103. As a result, if the striker 101 moves then the bolt 105 moves in tandem. The striker 101 may have any size or shape that complements the size and shape of the first compartment 155. For example, the first compartment 155 and striker 101 may be cylindrical. The size and weight of the striker 101 may be selected to balance the air pressure exerted against striker and the force of the striker spring 129. The striker 101 also moves between two positions a cocked position and an activated position. In the activated position, the striker 129 contacts the valve 109 to activate the valve. In the cocked position, the striker 101 is at a proximal position in the first compartment and not in contact with the valve 109. In this position the valve 109 is closed and gas does not pass through the valve 109 into the bolt 105 and barrel 153.

The valve 109 includes a body, cups seal 111, cup seal spring 113 and cup seal pin 107. The striker 101 opens the valve 109 by contacting the cup seal pin 107. The cup seal pin 107 in turn pushes the cub seal 111 away from the valve body allowing gas to pass through the valve 109 into the first compartment and into the barrel 153 if the bolt 105 is positioned to open the airflow path. The cup seal spring 113 biases the valve to a closed position by pressuring the cup seal 111 into the valve body.

A second compartment 157 includes a striker spring 129 and striker spring housing 125. A front compartment plug 119 seals the second compartment 157 and provides access to the second compartment 157, if removed. The front compartment plug may be screwed into or similarly attached to the second compartment 157 to seal it.

In one embodiment, the striker spring 129 biases the striker 101 to an activated position by exerting a force on the striker spring housing 125 pushing it toward the distal end of the marker. The striker spring housing 125 is connected to the striker 101 by a striker shaft 151 and thereby transfers the biasing force of the striker spring 129 to the striker 101.

The second compartment 157, striker spring housing 125 and striker spring 129 may have complementary shapes and sizes such that the striker spring housing 125 may be slidably disposed within the second compartment 157 and the striker spring 129 may engage the striker spring housing 125. The striker shaft 151 may be dimensioned with sufficient length to connect the striker 101 with the striker spring housing 125 and sufficient width and material strength to transfer the force of the spring to the striker 101 in the first compartment.

In one embodiment, the striker spring housing 125 engages a trigger assembly 133 through a sear 127. The sear 127 catches the striker spring housing 125 to hold it in a proximal position in the second compartment preventing it from advancing the striker 101 to activate the valve 109. Activation of the trigger assembly 133 by a user disengages the sear 127 from the striker spring housing 125 allowing the striker spring 129 to advance the striker spring housing 125 and the striker 101 thereby opening the valve 109 and propelling the paintball.

In one embodiment, the trigger assembly 133 is a mechanical trigger that controls the sear 127. The mechanical trigger assembly 133 may include a set of levers, springs or similar mechanisms to actuate the sear 127. In another embodiment, the trigger assembly 133 may include electronic components that enable automatic fire, multiple paintball firings per trigger pull or similar functionality. Electronic trigger components may include a trigger depression sensor, an integrated circuit for controlling the sear to affect the desired functionality and similar components. Electronic components may also provide other functionality or information related to the function of the marker or the operating conditions. For example, electronic components may include sensors for gas pressure, paintball count, temperature and similar conditions and electronic displays for displaying sensor information and similar electronic components.

In one embodiment, compressed gas may be provided as propellant for firing paintballs. The compressed gas may be compressed carbon dioxide, compressed air or similar compressed gas. The compressed gas may be stored in an internal storage device such as a sparklet or similar container. The container may be steel, aluminum, wound carbon-fiber or similar construction. The compressed gas container 149 may be disposed within a handle or similar cavity of the housing of the marker. The compressed gas container 149 may be held in position by a plug 147 or similar retaining mechanism. The compressed gas container 149 may engage the first compartment 155 of the valve 109 to supply pressurized gas into those spaces and components to be utilized to propel a paintball out of the marker. The compressed gas container 149 may be screwed into or similarly attached to the housing and the first compartment.

In one embodiment, the compressed gas container 149 may be removable and replaced when emptied. For example, the compressed gas container 149 may be a 12 g compressed $CO_2$ cartridges that can be replaced after it is expended. In another embodiment, the compressed gas container 149 may be refilled within the marker without removing it from the marker. In another embodiment, an external tank may be connected to the marker in place of a compressed gas container 149. The connection for an external gas tank may be disposed through the plug 147 or similarly attached. The source of gas and the pressure of the provided gas may be compensated by adjustment of the type, size, placement or force of the springs in the marker.

In one embodiment, the paintballs 135 may be fed into the marker by a charger 137. The charger 137 may contain any number of paintballs 135. The charger 137 may feed the paintballs 135 into the chamber or barrel 153 of the marker one at a time. The charger 137 may hold the paintballs in-line. In one embodiment, the charger 137 is substantially vertical within a handle portion of the marker. In another embodiment, the charger 137 may attach to the marker from a horizontal disposition or similarly engage the marker.

A latch mechanism 131 or similar mechanism may be used to hold paintballs 135 in the charger when a paintball is already in the barrel 153. The charger 137 may include a pusher 139, charger spring 143 and charger plug 145. The pusher 139 may be coupled to the charger spring 143, which exerts a biasing force on the pusher 139 to push the paintballs into the barrel 153 of the marker. The charger spring 143 may press against the charger plug 145 to compress the pusher 139 into the chamber or barrel 153 of the marker. The charger 137 may hold any number of paintballs. In one embodiment, the charger 137 may be removably attached to the marker. For example, the charger 137 may be removed when empty and another full charger may be inserted in its place while the original is reloaded. The charger 137 may be disposed entirely within the housing of the marker or may protrude from the housing, e.g., from the bottom of the handle, or similar have portions that are external to the housing.

In one embodiment, the pusher 139 or similar portion of the charger 137 may have an attached thumb pad 141 or similar structure to allow the manual advancement of the pusher 139 to advance a paintball into the marker or similarly service the marker.

In one embodiment, the housing of the marker may include a frame 123 and body 121 or similar components. The housing may have any number of sections that may be attached to one another to form a marker in the shape of a pistol or similar handgun. The components of the housing may be removably coupled to one another to allow access to the internal components to remove or maintain the internal components.

In one embodiment, a cocking block 115 may be attached to the marker over the housing. The cocking block 115 may have any shape or size sufficient to let a user grip the cocking block 115 to use it to ready the marker. The cocking block 115 may be used to move the striker mechanism and bolt from an activate position to a deactivated position if not automatically transitioned to that state during operation. The function of the cocking block 115 to position the bolt 105 is discussed below in further detail in regard to FIGS. 3A-3C.

Figure 2:
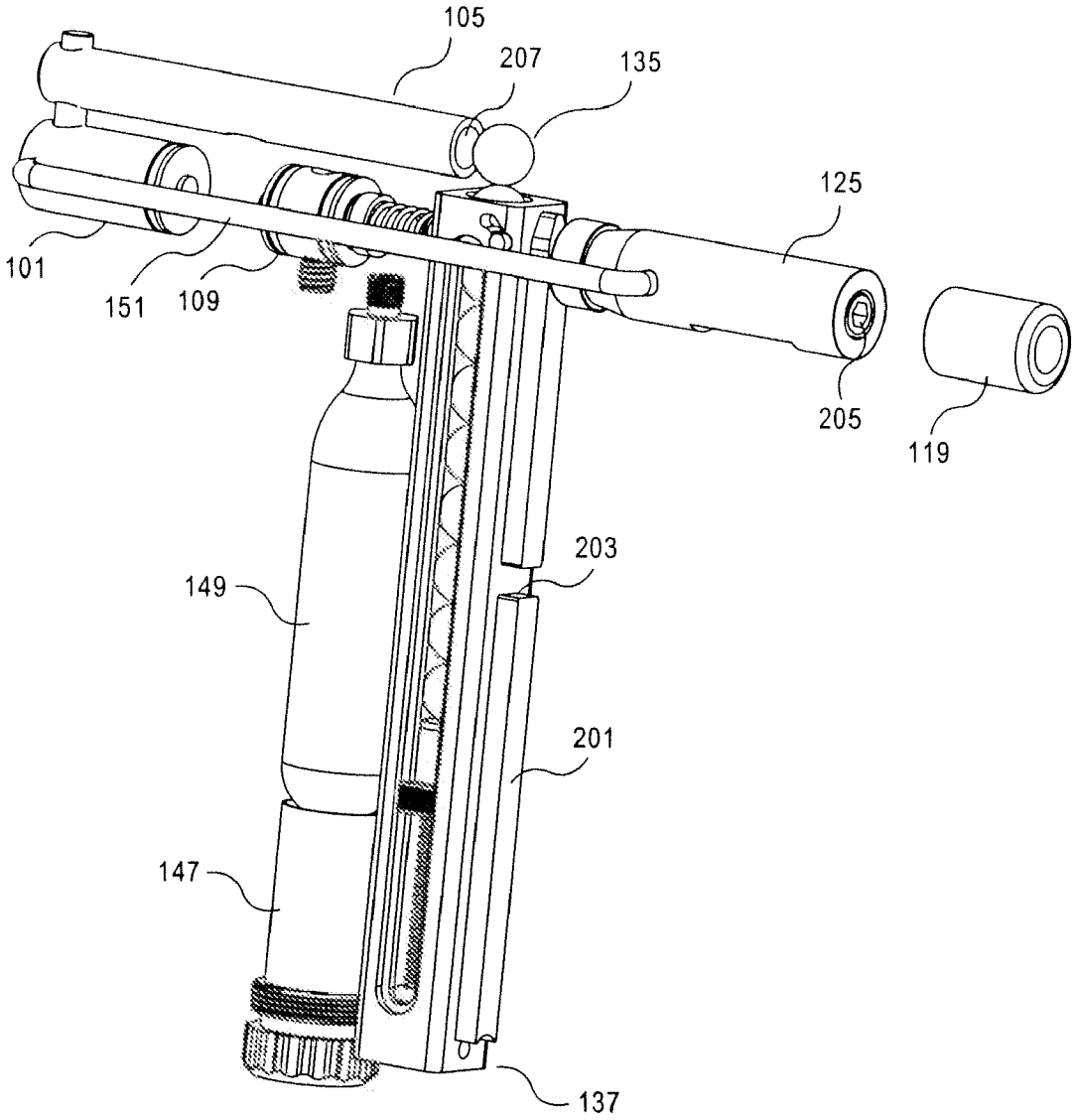
FIG. 2 is a diagram of sub-assemblies of one embodiment of the compact marker.

FIG. 2 is a diagram of sub-assemblies of one embodiment of the compact marker. This diagram isolates the striker, charger and gas compression container sub-assemblies. This perspective depicts one embodiment where the striker spring housing 125 defines a distal opening through which air may pass. Similarly, the front compartment plug 119 may also define an opening through which air may pass. These openings allow the striker spring housing 125 to move within the second compartment without having to overcome resistance due to air compression in the second compartment. Pressure in the compartment may be normalized through these openings.

In one embodiment, the charger housing 203 may partially or totally encompass the paintballs within the housing as well as the components of the charger 137. The housing 203 of the charger 137 may also define an engagement or retention mechanism 201 to hold the charger 137 in place within the marker housing after insertion or guide the charger 137 during insertion or similarly allow the charger 137 to engage the marker.

In one embodiment, the bolt 105 may define an opening 207 to an internal cavity that may link with the first compartment if the bolt 105 is properly positioned. The opening 207 may have any shape or size within the limits of the bolt structure 105. For example, the internal cavity of the bolt 105 may be substantially cylindrical to apply an even force to the surface of the paintball 135 as it is propelled out of the marker.

Figure 3A:
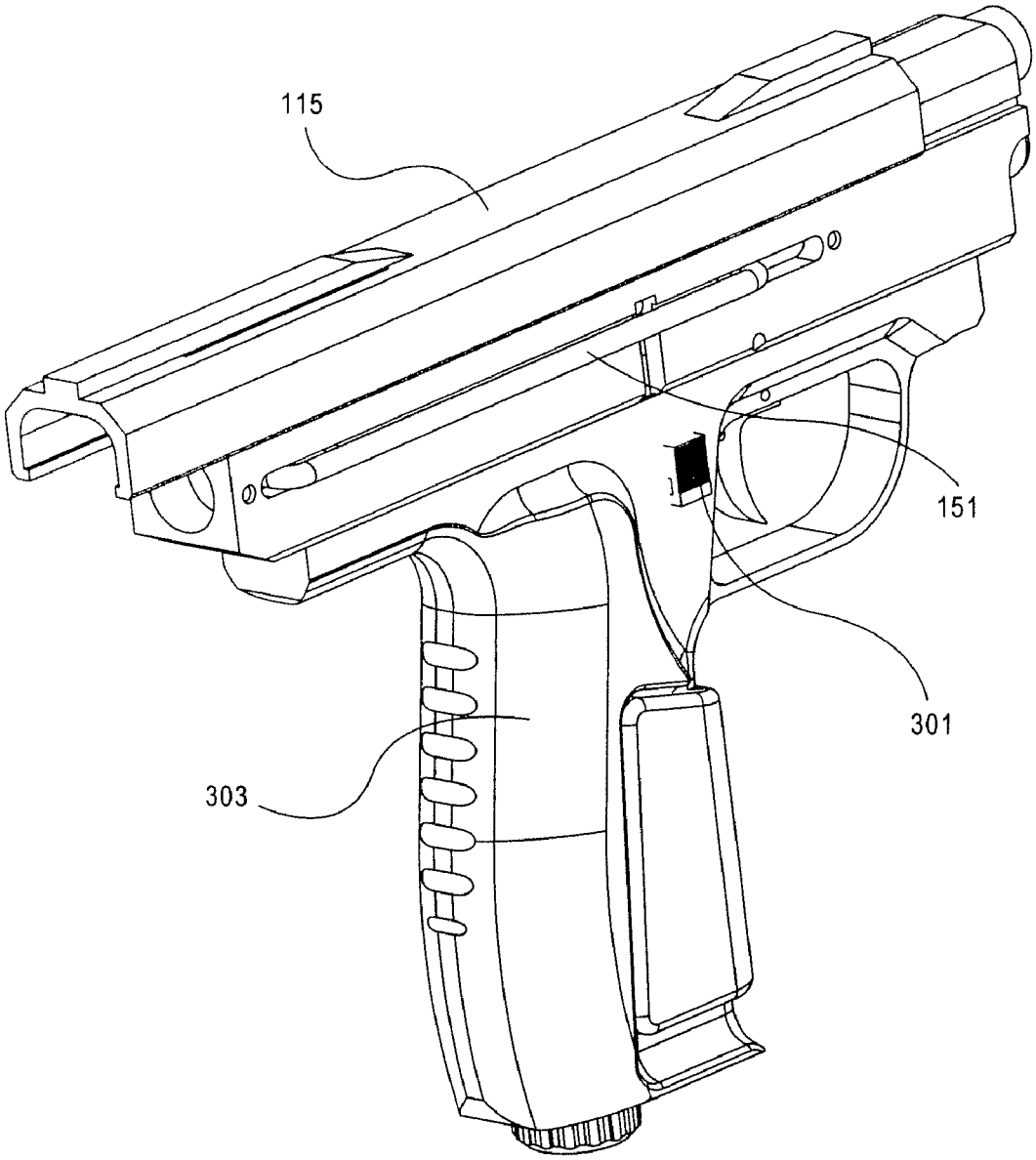
FIG. 3A is a diagram of the external housing of one embodiment of the compact marker.

FIG. 3A is a diagram of the external housing of one embodiment of the compact marker. In one embodiment, the external housing 303 may have any number of individual sections, plates or similar components. The housing may be constructed from metal, plastics, resins or similar materials or combinations thereof. The housing may be shaped to define a handle portion and projection portion.

In one embodiment, the housing may define a space that allows the striker shaft 151 to move between two different positions. Similarly, the cocking block 115 may cover or sheath a portion of the housing. The cocking block 115 may be slidably coupled to the marker through an opening defined by the housing, allowing the cocking block 115 to engage the bolt mechanism in a back position. The cocking block 115 may have any shape, size or dimensions suitable for being gripped by the user to ready the marker for firing. In one embodiment, the cocking block 115 may define a set of sights or similar structures common to markers.

Figure 3B:
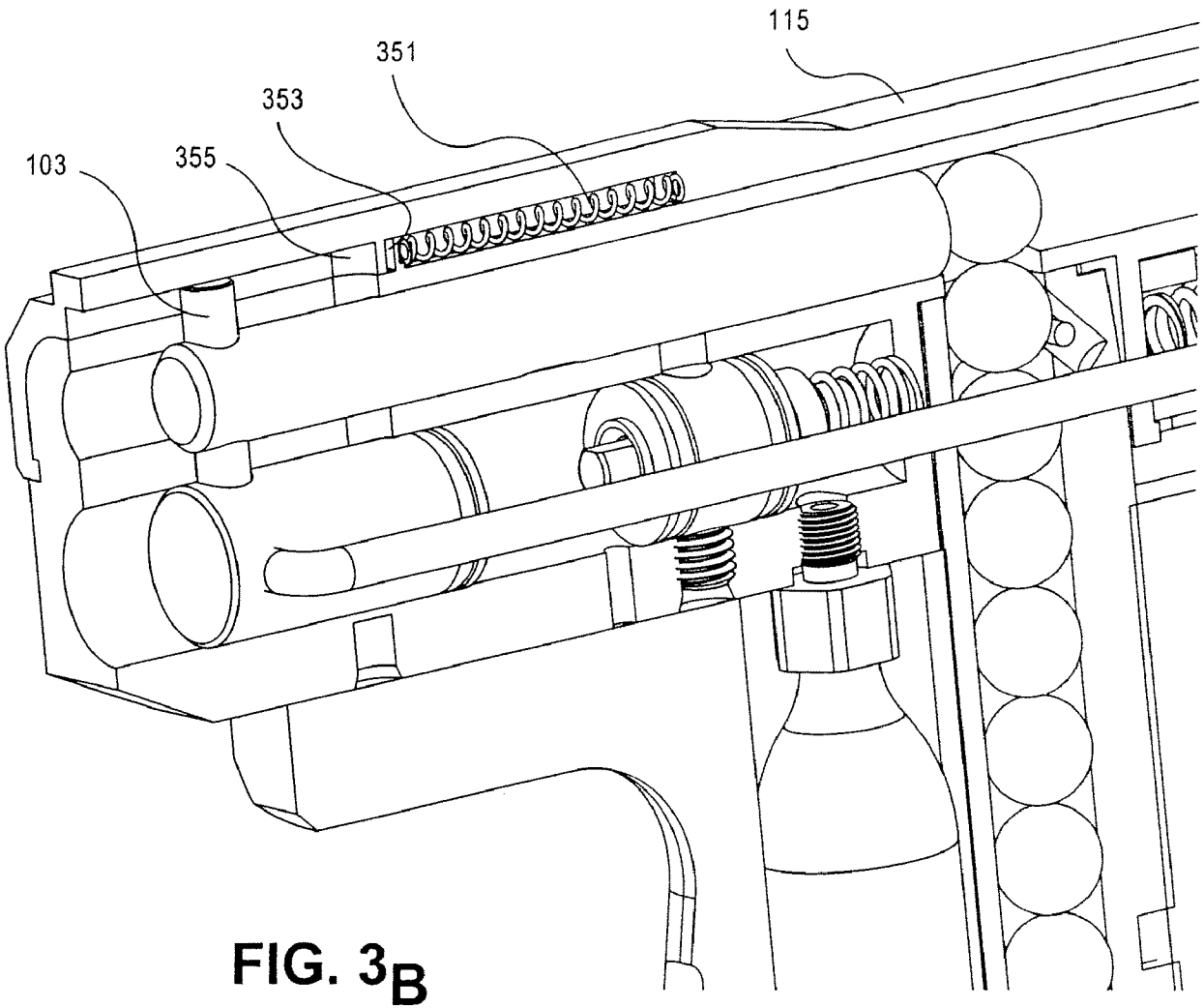
FIG. 3B is a diagram of one embodiment of a cocking block in a front position.

FIG. 3B is a cross-sectional diagram of one embodiment of the cocking block in a front position. In one embodiment, the cocking block 115 may be held in a front position by the force of a cocking block return spring 351. The cocking block return spring 351 may bias the position of the cocking block 115 to the front position. The cocking block return spring 351 may be disposed between the cocking block 115 and an upper surface of the marker. The cocking block return spring 351 may press against a protrusion 353 of the upper surface of the marker to bias the cocking block 115. A protrusion 355 of the lower surface of the cocking block 115 may prevent the sliding of the cocking block 115 toward the distal end of the marker.

Figure 3C:
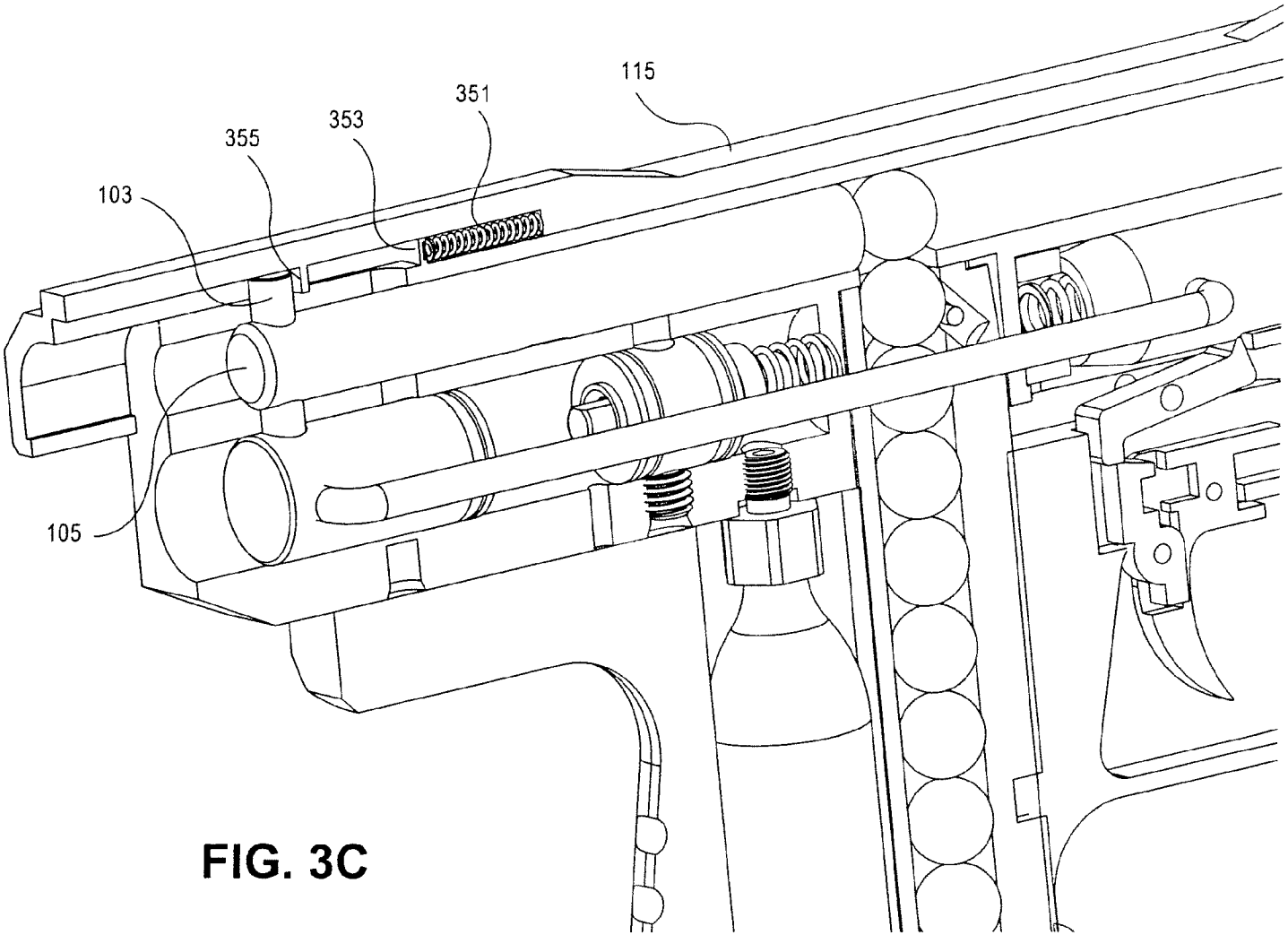
FIG. 3C is a diagram of one embodiment of a cocking block in a back position.

FIG. 3C is a cross sectional diagram of one embodiment of the cocking block in a back position. A cocking block 115 may be advanced to a back position by the application of lateral force applied by a user. This movement causes the cocking block return spring 351 to be compressed against the protrusion 353 of the housing. If the manual force is removed then the compressed spring 351 will press the cocking block 115 back to the front position.

The cocking block 115 engages the bolt pin 103 in the back position. As a result, the bolt 105 may be advanced to a cocked position. The protrusion 355 on the lower surface of the cocking block 115 engages the bolt pin 103. This mechanism may be referred to a snap catch mechanism. In other embodiments, other types of mechanism for advancing the bolt 105 to the cocked position without tying it to the movement of cocking block in both directions may be utilized.

Figure 4:
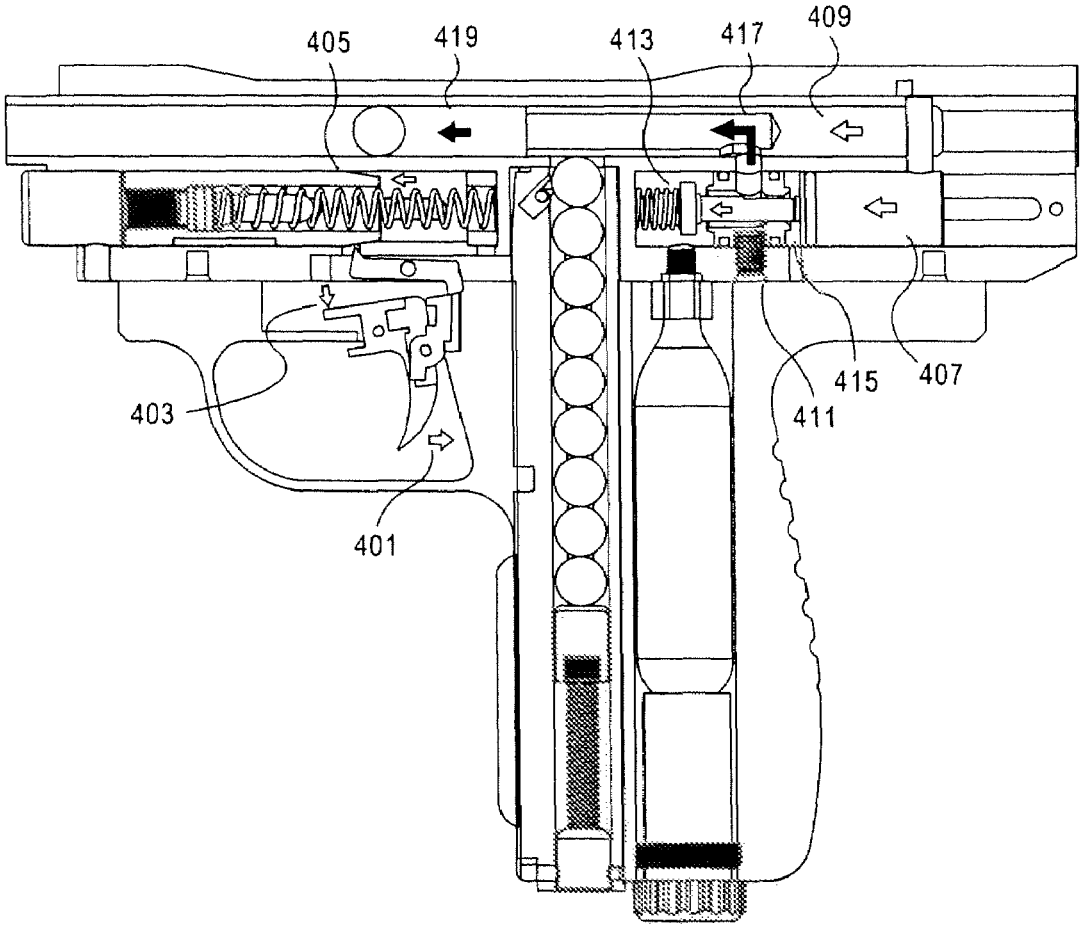
FIG. 4 is a diagram of one embodiment of mechanical and airflow movement in the compact marker during a firing action.

FIG. 4 is a diagram of one embodiment of mechanical and airflow movement in the compact marker during a firing action. In this figure mechanical movement is depicted with hollow arrows and airflow movement is depicted with solid arrows.

A firing action may be initiated by the depression of the trigger mechanism or similar activation of the trigger. The depression of the trigger 401 may cause several reactions within the trigger mechanism that ultimately result in the movement of the sear 403 to disengage from the striker spring housing. The striker spring expands and pushes the striker spring housing 405 toward the distal end of the marker. This causes the striker and bolt to move toward the distal end of the marker 407, 409. The striker engages the valve and cup seal pin causing the cup seal to break its seal 411.

Compressed gas that had been trapped in the distal end of the first compartment flows through the broken cup seal 413 into the bolt 417 and out through the barrel of the marker propelling the paintball in the barrel out of the marker toward its target. Simultaneously, gas presses against the striker causing it to push back the striker to the cocked position.

Figure 5:
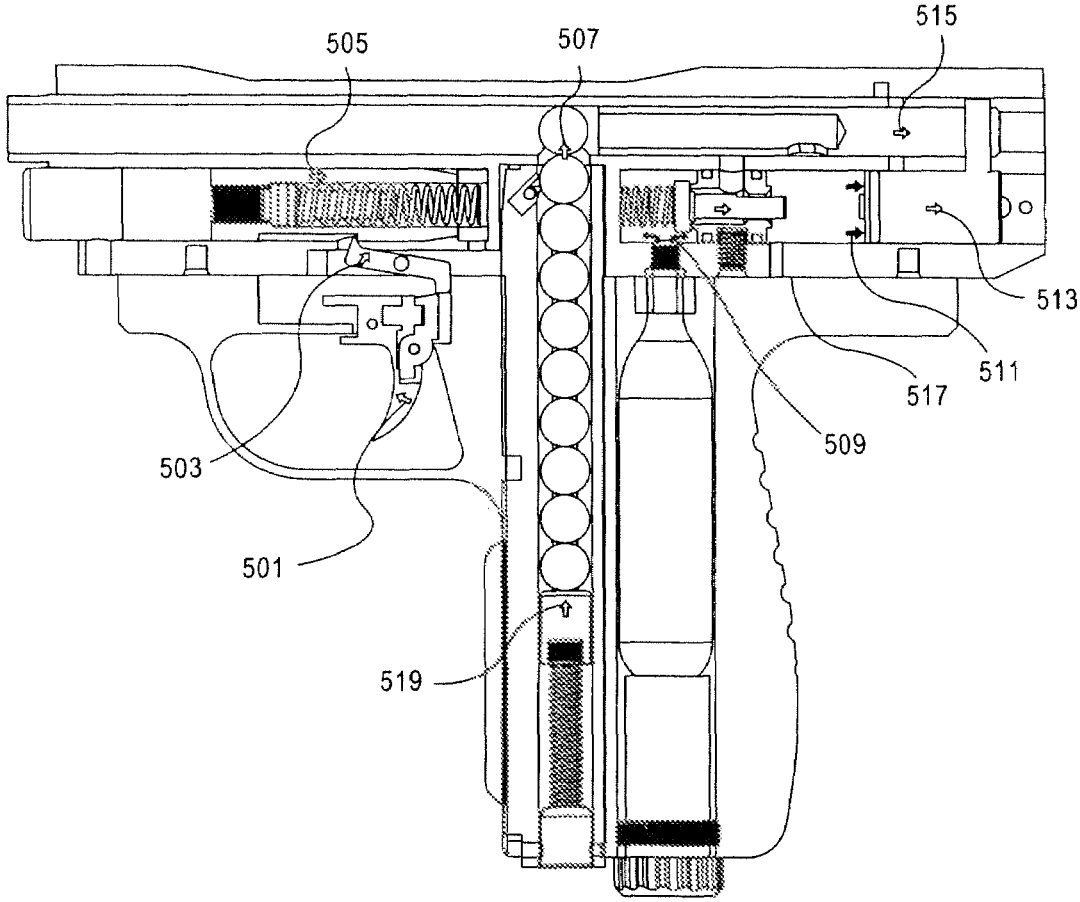
FIG. 5 is a diagram of one embodiment of mechanical and airflow movement in the compact marker during recovery.

FIG. 5 is a diagram of one embodiment of mechanical and airflow movement in the compact marker during recovery. This figure depicts the recovery action of the marker. In one embodiment, the compressed air pressure on the striker pushes it toward the proximal end of the first compartment 513. This removes pressure on the cup seal pin allowing it to close 517. The distal end of the first compartment then fills with compressed gas 509. This gas can subsequently be released during the next firing cycle. The movement of the striker also moves the bolt back to a cocked position 515. The bolt then closes off the flow of gas to the barrel.

The movement of the striker pulls the striker spring housing toward the proximal end 505 of the second compartment, compressing the spring and catching the sear 503 to hold the striker spring housing in place. The trigger mechanism may return to a rest position if the user is no longer depression the trigger 501. A user may also continue to depress the trigger without affecting the recover process.

The charger may push another paintball into the empty barrel 519 once the bolt has retracted opening the path to the barrel allowing a single paintball to enter the empty barrel 507. The recovery process thereby prepares the marker to fire the next paintball in a semi-automatic fashion.

Figure 6:
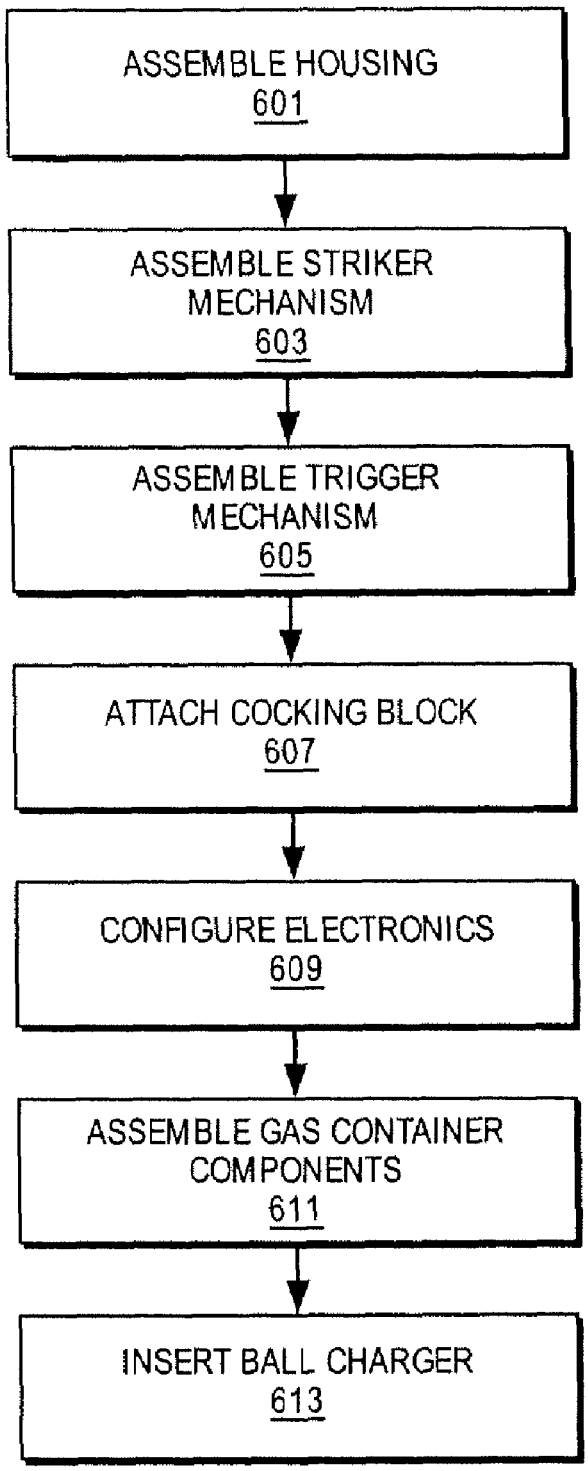
FIG. 6 is a diagram of one embodiment of a process for manufacturing the compact marker.

FIG. 6 is a diagram of one embodiment of a process for manufacturing the compact marker. In one embodiment, a marker manufacturer may be responsible for the assembly of the marker. In another, embodiment, the manufacturer may also fabricate at least some of the parts of the marker. The marker may be mass produced by automated or manual assembly.

In one embodiment, the assembly process may begin with the assembly or partial assembly of the housing of the marker (block 601). The individual components of the housing may be fabricated out of metals such as aluminum, steel and similar metals, plastics, resins and similar materials. The components may be combined by machining, attachment mechanisms such as snap fit, screws, interlocking parts, welding or similar techniques.

In one embodiment, the striker assembly may then be inserted into the housing or partially constructed housing (block 603). The striker assembly components may be fabricated from metals, plastics, resins and similar materials. The components of the striker assembly may include a set of O-rings that prevent the leakage of gas around them thereby forming an airtight compartment. The striker assembly may be calibrated or similarly tested to ensure that the striker assembly is properly balanced against the air pressure supplied to the marker to ensure that the marker will recover properly.

In one embodiment, the trigger assembly may then be added to the housing. The trigger assembly may include any combination of mechanical or digital components (block 607). Different models may have different components. For example, high end models may have digital components and features that allow for multiple paintballs to be fired in succession with any action by the user or similar functionality. Low end models may have entirely mechanical triggering mechanisms.

In one embodiment, the cocking block may be attached to the bolt of the marker over the top portion of the marker (block 609). The cocking block may have any shape or dimensions. In one embodiment, electronics such as temperature gauges, compressed air gauge, firing control and similar components may be added to the marker (block 611). These components may be programmed prior to installation or after installation.

In one embodiment, the manufacturer may also assemble the gas delivery components. The main container may be placed in the handle of the marker. The container may be removed for filling and locked back into place using the plug. In other embodiments, the gas delivery components may be fixed in the system or external to the system.

In one embodiment, a ball charger may be added to the marker (block 613). The ball charger may be added as integral part of the housing and components of the charger may be placed within the housing. In another embodiment, the charger may be added by a user after retail purchase.

In the foregoing specification, the embodiments of the invention have been described with reference to specific embodiments thereof. It will, however, be evident that various modifications and changes can be made thereto without departing from the broader spirit and scope of the invention as set forth in the appended claims. The specification and drawings are, accordingly, to be regarded in an illustrative rather than a restrictive sense.

What is claimed is:

1. A method comprising:

inserting a striker in a first compartment of a housing;

inserting a spring mechanism in a second compartment of a housing;

linking the striker and spring mechanism with a striker shaft, a portion of the striker shaft is external to the housing; and coupling a trigger mechanism to the housing to activate the striker to propel a paintball.

2. The method of claim 1, further comprising:

inserting a valve in the housing to release a flow of compressed air into the first compartment in response to activation by the striker.

3. The method of claim 2, further comprising:

inserting a spring in the first compartment to bias the valve to a closed position.

4. The method of claim 1, further comprising:

inserting a compressed gas canister into a handle of the housing to provide propellant to propel the paintball.

5. The method of claim 1, further comprising:

coupling a cocking block and bolt to the striker, the cocking block including a sheath covering a portion of the housing.

6. The method of claim 5, further comprising:

coupling the striker to the bolt with a bolt pin.

7. The method of claim 1,wherein the first compartment and second compartment are in line.

8. The method of claim 1, wherein the striker shaft is substantial parallel to a central axis of the striker.

* * * * *

UNITED STATES PATENT AND TRADEMARK OFFICE

CERTIFICATE OF CORRECTION

PATENT NO. : 7,621,265 B2
APPLICATION NO. : 12/350827
DATED : November 24, 2009
INVENTOR(S) : Fabrice N. V. Halmone It is certified that error appears in the above-identified patent and that said Letters Patent is hereby corrected as shown below:

On the Title Page, in Item [75], under Inventor, at line 1, please delete "Grande" and insert --Grand--.

Signed and Sealed this
Ninth Day of August, 2011

David J. Kappos

David J. Kappos
*Director of the United States Patent and Trademark Office*